US011589730B2

(12) United States Patent
Görtz

(10) Patent No.: US 11,589,730 B2
(45) Date of Patent: Feb. 28, 2023

(54) GLASS HOLDER ATTACHMENT

(71) Applicant: BSH Hausgeräte GmbH, Munich (DE)

(72) Inventor: Tanja Görtz, Langenau (DE)

(73) Assignee: BSH Hausgeräte GmbH, Munich (DE)

( * ) Notice: Subject to any disclaimer, the term of this patent is extended or adjusted under 35 U.S.C. 154(b) by 96 days.

(21) Appl. No.: 17/261,595

(22) PCT Filed: Aug. 14, 2019

(86) PCT No.: PCT/EP2019/071780
§ 371 (c)(1),
(2) Date: Jan. 20, 2021

(87) PCT Pub. No.: WO2020/038787
PCT Pub. Date: Feb. 27, 2020

(65) Prior Publication Data

US 2021/0259512 A1 Aug. 26, 2021

(30) Foreign Application Priority Data

Aug. 20, 2018 (DE) ..... 10 2018 214 019.7

(51) Int. Cl.
*A47L 15/50* (2006.01)
*A47L 19/04* (2006.01)

(52) U.S. Cl.
CPC ..... *A47L 15/505* (2013.01); *A47L 19/04* (2013.01)

(58) Field of Classification Search
CPC combination set(s) only.
See application file for complete search history.

(56) References Cited

U.S. PATENT DOCUMENTS 3,214,031 A 10/1965 McCauley
4,589,556 A 5/1986 Peretz
5,740,928 A * 4/1998 Dale ..... B67D 3/0083 248/153
5,865,326 A * 2/1999 Spamer ..... A47B 73/002 211/181.1
6,394,285 B1 * 5/2002 Arthurs ..... A47L 15/505 211/41.9

(Continued)

FOREIGN PATENT DOCUMENTS

CH 694033 A5 * 6/2004 ..... A47L 15/503
DE 1945681 U 9/1966

(Continued)

OTHER PUBLICATIONS

International Search Report PCT/EP2019/071780 dated Nov. 26, 2019.
National Search Report DE 102018214019 dated May 14, 2019.

*Primary Examiner* — Stanton L Krycinski
(74) *Attorney, Agent, or Firm* — Michael E. Tschupp; Andre Pallapies; Brandon G. Braun

(57) ABSTRACT

A glass holder attachment for a receptacle for items to be washed includes a holder configured to hold a plurality of stemmed glasses, a plurality of first feet to enable the glass holder attachment to be set on the receptacle and washed together with the stemmed glasses in a household dishwasher, and a plurality of second feet to enable the glass holder attachment to be set down on a level surface in such a manner that the stemmed glasses are arranged at a distance above the surface.

15 Claims, 5 Drawing Sheets

(56) References Cited

U.S. PATENT DOCUMENTS

| | | | | | |
|---|---|---|---|---|---|
| 6,827,006 | B1 * | 12/2004 | D'Amato et al. | A47J 37/0694 | 99/426 |
| D518,936 | S * | 4/2006 | Yang | D32/55 | |
| D605,909 | S * | 12/2009 | Wax | D7/704 | |
| D706,009 | S * | 5/2014 | Cooper | D32/58 | |
| D762,035 | S * | 7/2016 | Cooper | D32/55 | |
| 10,052,012 | B2 * | 8/2018 | Mesa | A47L 15/50 | |
| 10,159,397 | B2 * | 12/2018 | Citak | A47L 15/505 | |
| 10,342,409 | B2 * | 7/2019 | Wilson | A47L 15/4293 | |
| 2016/0270628 | A1 * | 9/2016 | Ben-Haim | A47L 15/505 | |
| 2017/0135553 | A1 | 5/2017 | Rickard et al. | | |

FOREIGN PATENT DOCUMENTS

| | | | | | |
|---|---|---|---|---|---|
| DE | 4309915 | A1 * | 9/1994 | A47L 15/502 | |
| DE | 10106763 | A1 * | 8/2002 | A47L 15/503 | |
| DE | 10106763 | A1 | 8/2002 | | |
| DE | 102015004194 | A1 * | 10/2016 | | |
| EP | 1413241 | A1 * | 4/2004 | A47L 15/502 | |
| EP | 2815690 | B1 * | 6/2016 | A47L 15/505 | |
| GB | 993999 | A | 6/1965 | | |
| KR | 100613482 | B1 * | 8/2006 | | |
| WO | 2016000791 | A1 | 1/2016 | | |
| WO | WO-2018041553 | A1 * | 3/2018 | A47L 15/50 | |
| WO | 2018065845 | A1 | 4/2018 | | |

* cited by examiner

GLASS HOLDER ATTACHMENT

CROSS-REFERENCES TO RELATED APPLICATIONS

This application is the U.S. National Stage of International Application No. PCT/EP2019/071780, filed Aug. 14, 2019, which designated the United States and has been published as International Publication No. WO 2020/038787 A1 and which claims the priority of German Patent Application, Serial No. 10 2018 214 019.7, filed Aug. 20, 2018, pursuant to 35 U.S.C. 119(a)-(d).

BACKGROUND OF THE INVENTION

The present invention relates to a glass holder attachment, a unit and a household dishwasher.

The publication WO 2018/065845 A1 discloses a glass holder attachment for a crockery basket. The glass holder attachment comprises two rods, a plurality of stemmed glasses being able to be clamped therebetween in a row. Downwardly extending feet are attached to the rods opposite one another. The glass holder attachment may be supported by means of the feet on an upper frame element of the crockery basket, whilst the stemmed glasses are held suspended downwardly.

BRIEF SUMMARY OF THE INVENTION

Against this background, it is the object of the present invention to provide an improved glass holder attachment, an improved unit and an improved dishwasher.

Accordingly, a glass holder attachment for a receptacle for items to be washed is provided. The glass holder attachment comprises a holder for holding a plurality of stemmed glasses (hereinafter also called "glasses"), a plurality of first feet, with the aid of which the glass holder attachment can be set on the receptacle for items to be washed for the purpose of washing said attachment along with the stemmed glasses in a household dishwasher (hereinafter also called "dishwasher"), and a plurality of second feet, with the aid of which the glass holder attachment can be set down on a level surface in such a manner that the stemmed glasses are arranged at a distance above the surface.

Accordingly, the glass holder attachment may be set down, for example, on a surface in the form of a kitchen worktop. The glass holder attachment may be filled with soiled glasses there. Subsequently the glass holder attachment is set onto the receptacle for items to be washed. In particular, in this case the receptacle for items to be washed may be arranged on a folded-out door of the dishwasher. Then the receptacle for items to be washed together with the glass holder attachment and the stemmed glasses held thereby may be moved into a washing chamber of the dishwasher and cleaned there. At the end of the washing process, the glass holder attachment together with the stemmed glasses may be removed from the dishwasher; optionally this is carried out after pulling out the unit consisting of the glass holder attachment and receptacle for items to be washed from the washing chamber onto the door of the dishwasher. In this case, the glass holder attachment is simply lifted from the receptacle for items to be washed. The glass holder attachment together with the stemmed glasses may then be set down onto the surface. The washed glasses may then be simply removed from the glass holder attachment and put away into a rack or the like.

The receptacle for items to be washed is a device for receiving soiled crockery and/or cutlery for use in a dishwasher. For example, the receptacle for items to be washed may be a crockery basket, in particular a lower or upper crockery basket. A receptacle for items to be washed in the form of a cutlery basket or a cutlery drawer is also conceivable. Insofar as in the present case a "basket" is referred to, this is understood to mean a lattice structure which is configured in the shape of a container, wherein lattice elements of the lattice structure are produced from metal, in particular wire, and/or plastic.

The surface may be a kitchen surface, for example of a kitchen worktop. "Level" means that the surface forms a plane having the same or substantially the same height.

The stemmed glasses may be, for example, wine or champagne glasses.

Insofar as in the present case "up", "down", "high" or "height" is referred to, this relates to the direction of gravity.

According to one embodiment, one or more of the first feet are identical with one or more of the second feet.

In other words, therefore, one and the same foot may serve both for setting the glass holder attachment onto the receptacle for items to be washed and for setting down the glass holder attachment onto the surface. In principle, it is conceivable that all of the feet (first and second) have this dual function. However, generally this will not be required. Instead, it is sufficient if, for example, four feet which have the dual function are provided, i.e. in each case functioning as first and second feet. Four feet of this type namely ensure a secure positioning of the glass holder attachment on the level surface. Moreover, for example, two, three, four or more further feet may be provided which exclusively function as first feet rather than second feet. Thus the further feet are provided exclusively for setting the glass holder attachment onto the receptacle for items to be washed. The further feet ensure—in addition to the above-described feet—an additional support of the glass holder attachment on the receptacle for items to be washed and thus ensure an improved positioning thereon. In other embodiments it could also be provided that none of the feet has the above-described dual function, i.e. those feet which are provided for setting the glass holder attachment onto the receptacle for items to be washed and other feet which are provided for setting down the glass holder attachment on the surface.

According to a further embodiment, the first and second feet have a U-shape which is designed to encompass partially a wire element of the receptacle for items to be washed when the glass holder attachment is set thereon, and to be positioned with its free ends on the surface when the glass holder attachment is set down thereon.

By means of such a U-shape the glass holder attachment may be reliably prevented from slipping off the receptacle for items to be washed in the state thereof when it has been set thereon. However, other structural embodiments, which prevent such slipping, are also conceivable. For example, the first and second feet could be insertable in recesses or pockets provided on the receptacle for items to be washed. A "U-shape" in the present case is to be understood to mean that other geometric shapes which are comparable in their effect are also encompassed, for example a V-shape or semi-circular shape.

According to a further embodiment, one or more of the first feet are designed to be set on an upper side edge of the receptacle for items to be washed.

This results in a secure support of the glass holder attachment set on the receptacle for items to be washed.

According to a further embodiment, one or more of the second feet are designed to be set on a base of the receptacle for items to be washed.

This also ensures a correct positioning of the glass holder attachment on the receptacle for items to be washed due to the further supporting points thus provided. This has the result that the second feet are configured to be longer (hereinafter also denoted as "long" feet) than those of the first feet, which are designed to be set on the upper edge of the receptacle for items to be washed (hereinafter also denoted as "short" feet).

Preferably one or more of the first or second feet (or even all thereof) have a rod-shaped portion. The aforementioned U-shape may be adjoined to this rod-shaped portion. The rod-shaped portion is configured to be of variable length according to whether the foot is a long or a short foot.

According to a further embodiment, the first and/or second feet are attached to the holder.

This may be provided indirectly or directly. Thus the first and second feet may be connected to the holder, for example, by means of a frame which is described in more detail below (indirect fastening).

According to a further embodiment, one or more of the first and/or second feet are provided to be pivotable.

As a result, the glass holder attachment may be stowed in a space-saving manner when it is not required, for example in a kitchen cabinet. In particular, it may be provided that all of the second feet, i.e. all of the long feet, are provided to be pivotable. Accordingly, the short feet may be attached fixedly, i.e. not pivotably, to the holder. Moreover, it may also be provided that—instead of the pivotable fastening—the long feet may be provided to be removable from the holder. To this end, the long feet are releasably fastened to the holder. The same could also be provided for the short feet.

According to a further embodiment, the glass holder attachment has handles for setting the glass holder attachment onto the receptacle for items to be washed and for setting down the glass holder attachment on the surface.

The handles may be configured, for example, to be U-shaped. In particular, the handles may be formed from plastic and/or metal, in particular wire. Preferably two, three or four handles are provided.

According to a further embodiment, the holder is designed to hold the stemmed glasses suspended in a row and/or in an inclined manner.

"Suspended" means that the stemmed glasses are held at the stem thereof and/or the foot thereof, whereby the bowl is oriented downwardly. This improves the drying thereof. The drying is even further improved by the stemmed glasses additionally being held in an inclined manner, since as a result a single drip-off point is provided.

According to a further embodiment, the holder has at least two parallel rods which are spaced apart from one another in order to receive the stems of the stemmed glasses therebetween, wherein at least one of the rods is designed to support the feet adjoining the stems upwardly.

As a result, the above-described suspended holder of the stemmed glasses may be implemented in a simple manner. In particular, the holder may have a plurality of pairs of two parallel rods in each case. As a result, a plurality of rows of stemmed glasses may be held in parallel adjacent to one another. Preferably, it is provided that the two parallel rods are fastened in each case at one side to a frame, described in further detail below. At their respective ends the two parallel rods are free so that from this side the stemmed glasses may be inserted between the two parallel rods. Preferably, the open side of the (U-shaped) frame, described in more detail below, corresponds to the free ends of the rods so that the stemmed glasses may be moved via the open side of the frame to the free ends of the rods and at that point may be inserted therebetween.

According to a further embodiment, the rods are arranged at different heights.

As a result, the above-described inclined holder of the stemmed glasses may be produced in a simple manner. The stem of one respective stemmed glass, therefore, is located at two points at different heights on opposing sides of the respective stem.

According to a further embodiment, the glass holder attachment has a U-shaped frame with two lateral frame elements and a rear frame element arranged therebetween, wherein the holder is attached to the rear frame element, the first and/or second feet are attached to the lateral frame element and/or the handles are attached to the lateral frame element.

The frame elements may be produced from plastic and/or metal, in particular from wire. Preferably, it is provided that in each case the short feet extend downwardly from ends of the frame elements. It may further be provided that in each case two long feet are provided on the lateral frame elements, said long feet extending downwardly therefrom. The long feet are provided, in particular, between two respective short feet on one respective lateral frame element. The handles may be provided on the two lateral frame elements such that they extend upwardly. The handles are thus able to be reached in a particularly simple manner by an operator.

A unit comprising a receptacle for items to be washed and a glass holder attachment as described above is also provided. The glass holder attachment is set onto the receptacle for items to be washed and is removable therefrom in order to set down the glass holder attachment on a level surface.

Moreover, a household dishwasher comprising the above-described unit is provided.

The embodiment and developments described for the glass holder attachment accordingly apply to the unit and the household dishwasher.

Further possible implementations of the invention also comprise not explicitly cited combinations of features or embodiments described above or below relative to the exemplary embodiments. In this case, the person skilled in the art will also add individual features as improvements or additions to the respective basic form of the invention.

BRIEF DESCRIPTION OF THE DRAWINGS

Further advantageous embodiments and features of the invention form the subject matter of the subclaims and the exemplary embodiments of the invention described below. The invention is described in more detail hereinafter by means of preferred embodiments, with reference to the accompanying figures, in which:

DETAILED DESCRIPTION OF EXEMPLARY EMBODIMENTS OF THE PRESENT INVENTION

Figure 1:
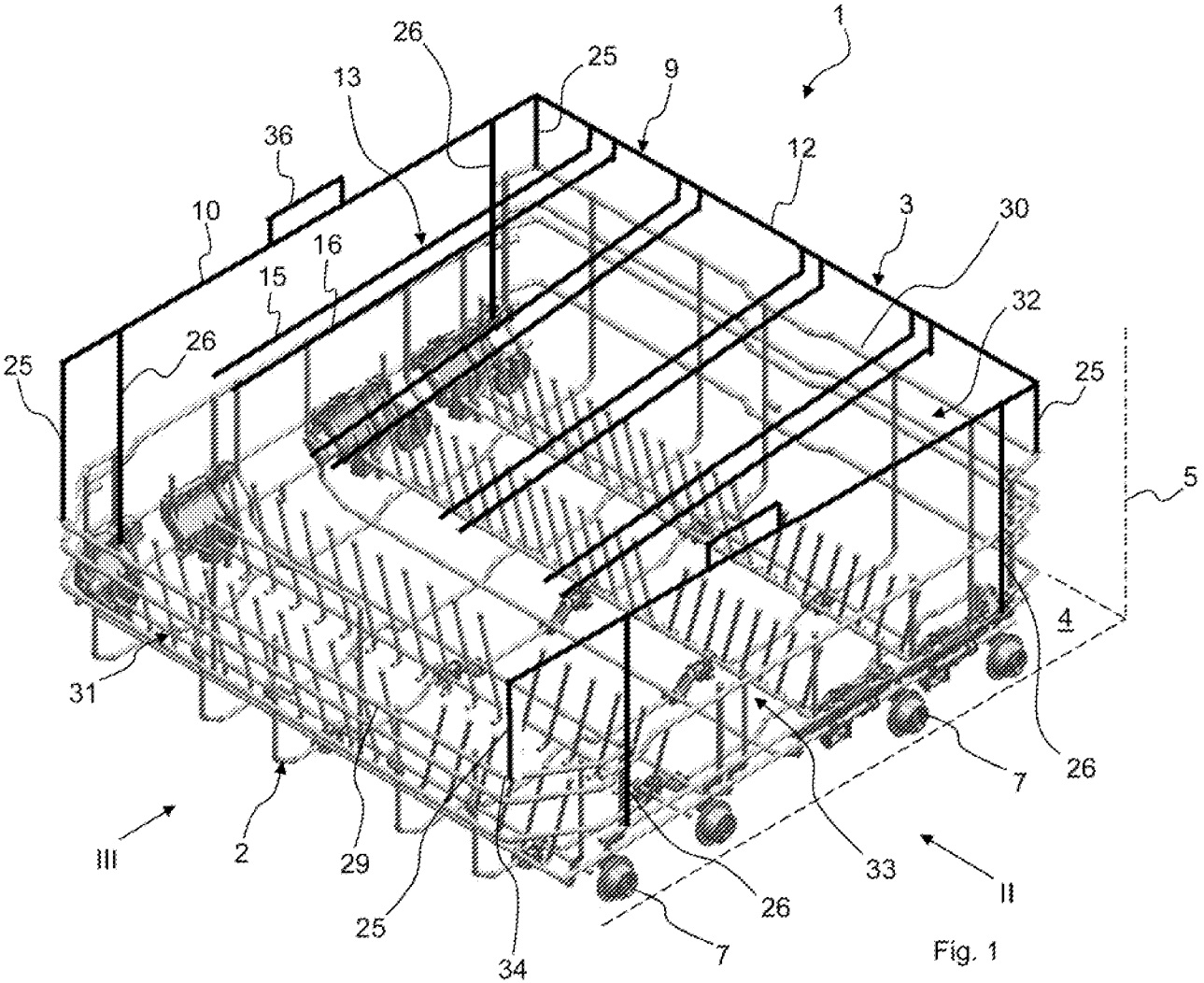
FIG. 1 shows in a perspective view a unit comprising a receptacle for items to be washed and a glass holder attachment which is set onto the receptacle for items to be washed, according to an embodiment.

In the figures identical reference numerals denote components which are identical or functionally identical.

FIG. 1 shows a unit 1 in a perspective view. The unit 1 comprises a lower basket 2 and a glass holder attachment 3 which is set on the lower basket 2.

During a washing process the unit 1 is inserted into a washing chamber 4 of a household dishwasher 5 (indicated schematically). At the same time, stemmed glasses 6 held by the glass holder attachment 3 (see for example FIGS. 2 and 3 which show a view II and/or III of FIG. 1) are cleaned.

Following the washing process the glass holder attachment 3, together with the stemmed glasses 6, is removed from the dishwasher 5. To this end, the user may move, in particular, the unit 1 out of the washing chamber 4. This may be carried out in a simple manner by means of the rollers 7 provided on the lower basket 2, or in a different manner. The unit 1 which is moved, for example, onto the folded-down door (not shown) of the household dishwasher 5 is accessible to a user in a particularly simple manner.

Figure 5:
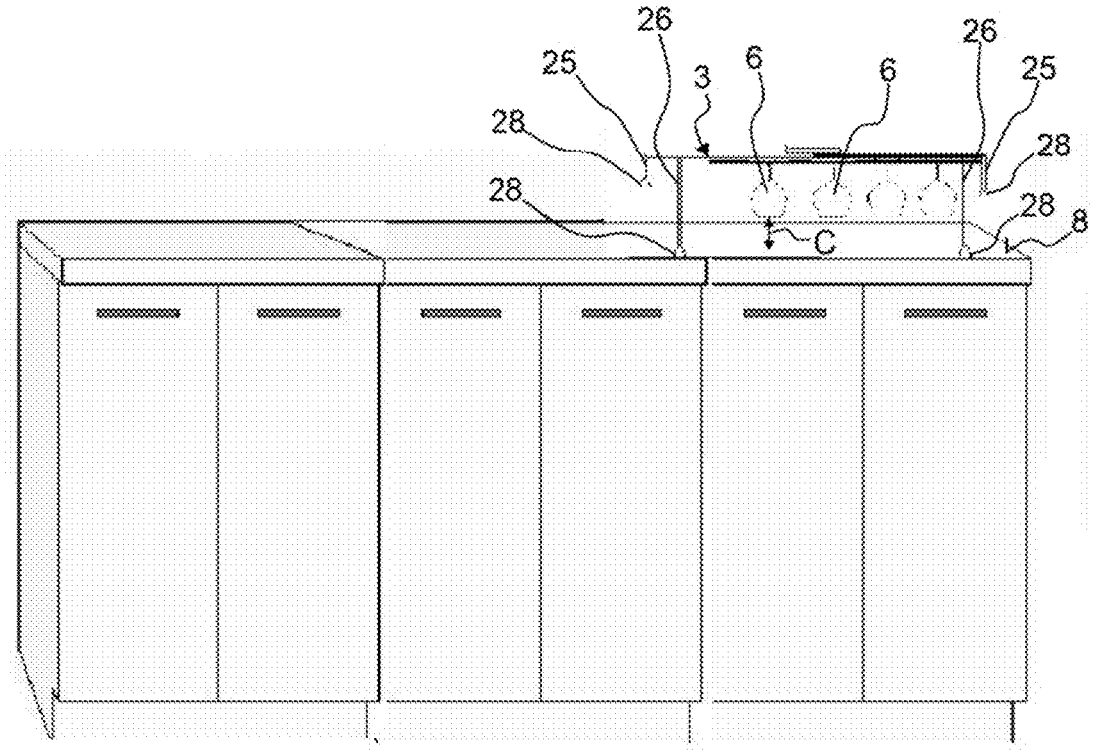
FIG. 5 shows in perspective the glass holder attachment of FIGS. 1 to 4 in a state in which this glass holder attachment is set down on a surface.

The removed glass holder attachment 3 may be set down in a simple manner, for example, on a worktop 8 shown in FIG. 5 (of a row of kitchen units, not denoted further). Then the cleaned stemmed glasses 6 may be removed therefrom and, for example, cleared away into a refrigerator.

Soiled glasses which are set down, for example, on the worktop 8 may be suspended in a simple manner in the glass holder attachment 3. The glass holder attachment 3 is then set onto the lower basket 2. This may also be carried out, for example, outside the washing chamber 4 on the folded-out door of the household dishwasher 5. Then the unit consisting of the glass holder attachment 3 and the lower basket 2 is pushed into the washing chamber 4. The soiled glasses 6 are washed there.

Figure 4:
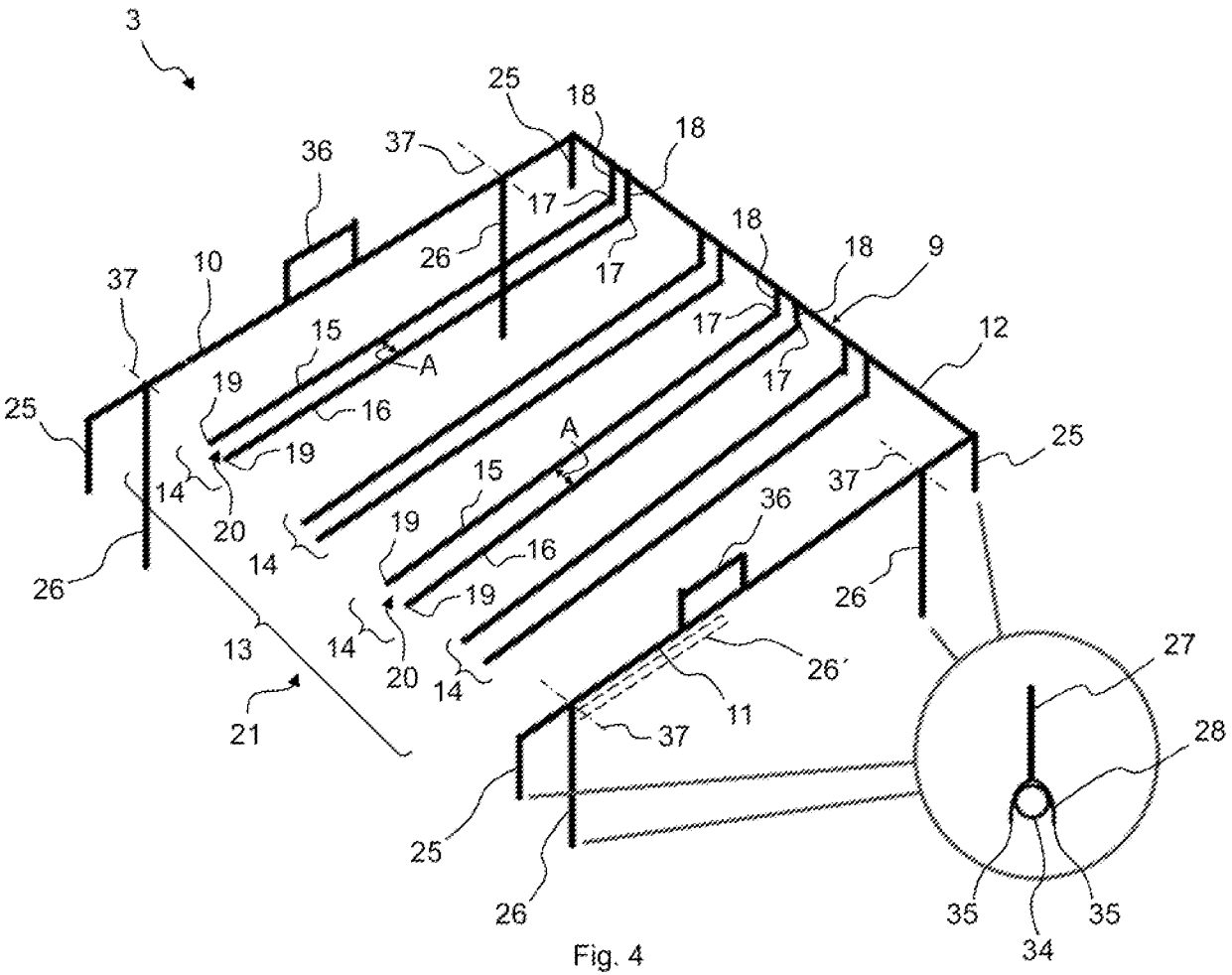
FIG. 4 shows in perspective the glass holder attachment of FIG. 1 in isolation, wherein the ends of the feet are shown to the right in an enlarged view.

In detail, to this end the glass holder attachment 3 may have the features described below:

FIG. 4 shows the glass holder attachment 3 of FIG. 1 in an isolated view. The glass holder attachment 3 has a U-shaped frame 9. The U-shaped frame 9 is composed of two lateral frame elements 10, 11 and a rear frame element 12 connecting these lateral frame elements. A holder 13 is attached to the rear frame element 12. The holder 13 comprises a plurality of pairs 14, four in the exemplary embodiment shown, of two parallel rods 15, 16 in each case. The rods 15, 16 in each case are horizontally oriented. At their respective rear ends 17 the rods 15, 16 are fixedly attached to the rear frame element 12. This may be carried out, for example, via rods 18 extending downwardly from the rear frame element 12. At their front ends 19 the rods 15, 16 are configured to be free so that an opening 20 is formed between two respective rods 15, 16. The openings 20 are located on the same side as an opening 21 of the frame 9 which is produced due to its U-shape (absent front frame element). Thus the stemmed glasses 6 could be pushed from the front face through the opening 21 in the frame 9 and the respective openings 20 onto the rods 15, 16.

Figure 7:
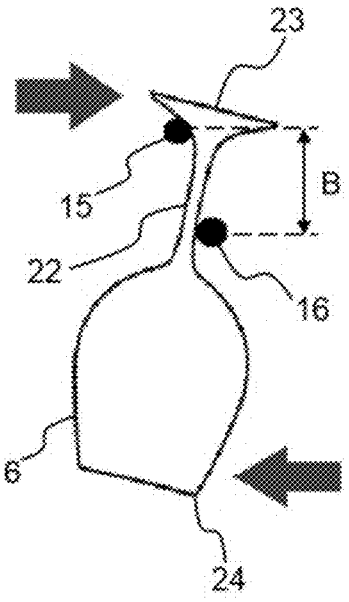
FIG. 7 shows by way of example a single stemmed glass which is held suspended obliquely.
Figure 3:
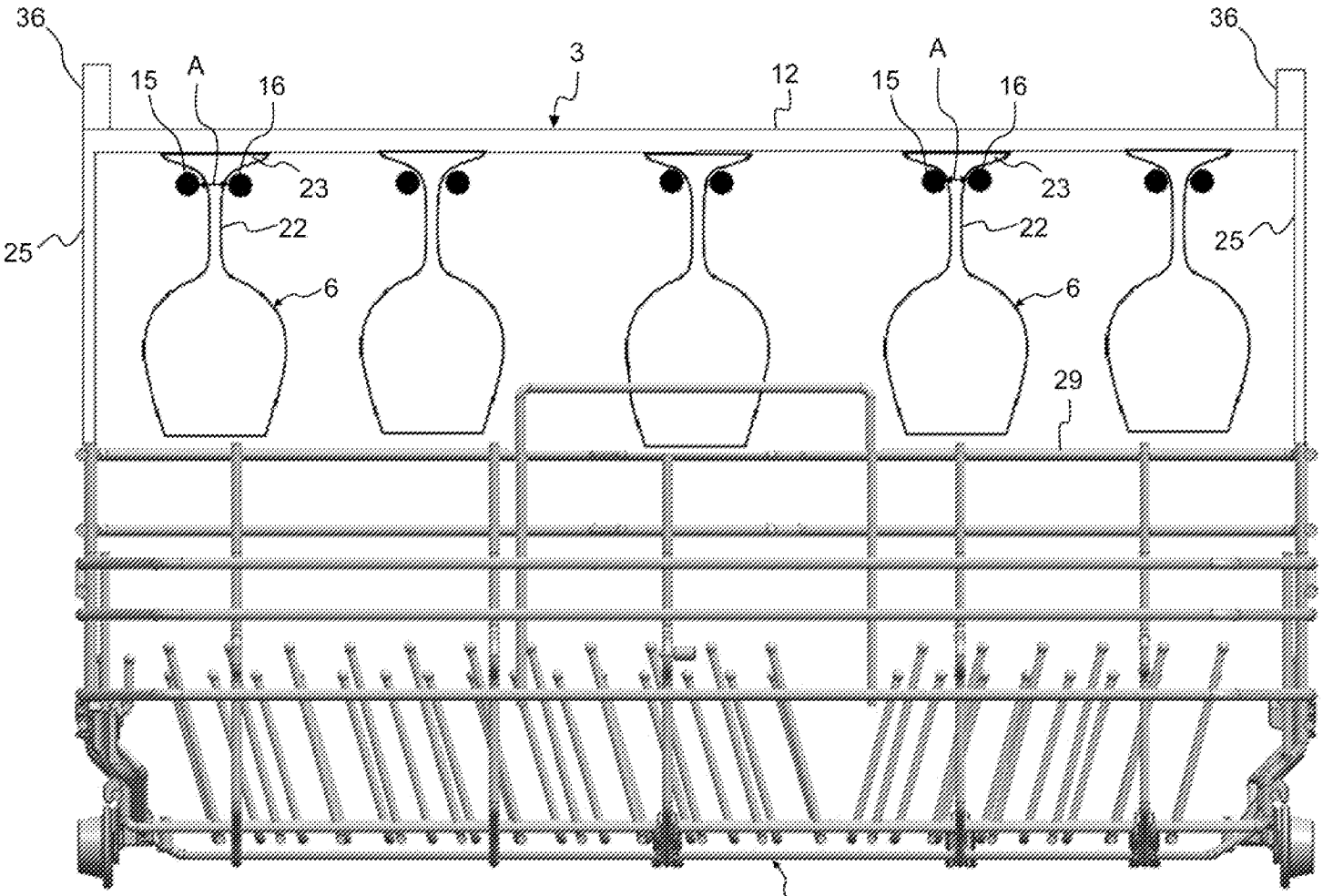
FIG. 3 shows a view III of FIG. 1.

The distance A between two rods 15, 16 is dimensioned in this case such that it corresponds to the diameter of the stems 22 (FIG. 3) of the stemmed glasses 6 in a region adjoining the respective foot 23 thereof. The glasses 6 are held suspended between the rods 15, 16, so that the rods support the feet 23 in the vertical direction. In FIG. 3, the glasses 6 are suspended straight down, the rods 15, 16 being arranged at the same height therefor. Preferably, however, it may be provided that the rods 15, 16 are offset, as may be seen in FIG. 7, identified here by an offset B in the vertical direction. In this case, the foot 23 is supported only on the rod 15. This results in an oblique hold of the glasses 6 illustrated by the opposing arrows in FIG. 7. This results in a single drip-off point 24 (lowest point of the glass) and promotes stain-free drying of the stemmed glasses 6.

Figure 2:
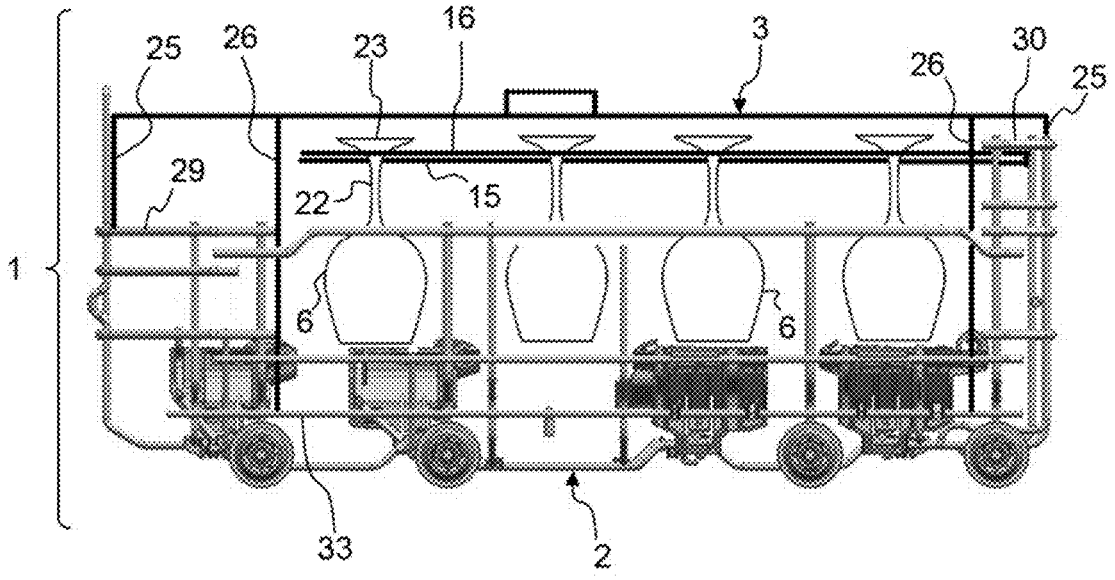
FIG. 2 shows a view II of FIG. 1.

Returning to FIG. 4 and viewed together with FIGS. 2 and 3, it may be seen that one respective pair 14 of rods 15, 16 may hold a plurality of, for example two, three, four, five, six or more, stemmed glasses 6 in one row.

Moreover, it may be seen in FIG. 4 that the glass holder attachment 3 has four short feet 25 and six long feet 26. Each foot 25, 26 in this case is composed of a rod-shaped portion 27 (see the enlarged view in FIG. 4 to the right) and a U-shape 28. The rod-shaped portion 27 is configured to be longer in the long feet 26 than in the short feet 25. The U-shape 28 in each case is configured on a lower end of the rod-shaped portions 27. At their upper end the rod-shaped portions 27 are fastened to the frame 9. For example, the short feet 25 may be fastened in each case to the ends of the frame elements 10, 11 whilst two long feet 26 are arranged in each case between two short feet 25 on the frame elements 10, 11.

The variable length of the feet has the function described below. Namely when viewing FIG. 1 it may be seen that the short feet 25 are set in each case on side edges 29, 30 of the lower basket 2. The side edges 29, 30 form the upper face of a basket front wall and/or basket rear wall 31, 32. The front and/or rear wall refers here to the pull-out direction of the lower basket 2 from the washing chamber 4. In this case, the basket rear wall 32 and thus also the side edge 30 may be configured to be higher than the front side wall 31 and thus the side edge 29. Accordingly, the rear feet 25 could also be configured to be shorter than the front feet 25. The long feet 26 are accordingly set on the basket base 33. It may be provided that in each case the feet 25, 26 are set on plastic-coated wire elements—denoted by way of example by the reference numeral 34. In this regard, the side edges 29, 30 and the basket base 33 may have such plastic-coated wire elements 34, in each case the feet 25, 26 being set thereon and namely with the U-shape 28 identified in the enlarged view in FIG. 4. The U-shape 28 in this case encompasses the wire element 34. As a result, the feet 25, 26 are respectively prevented from slipping off a wire element 34. The U-shape 28 may encompass the wire element 34, for example, over greater than or equal to 180° of its periphery. As a result, a positive connection is present in the vertical direction and in the horizontal direction between the U-shape 28 and the wire element 34. The wire element 34 is shown in section in FIG. 4.

Figure 6:
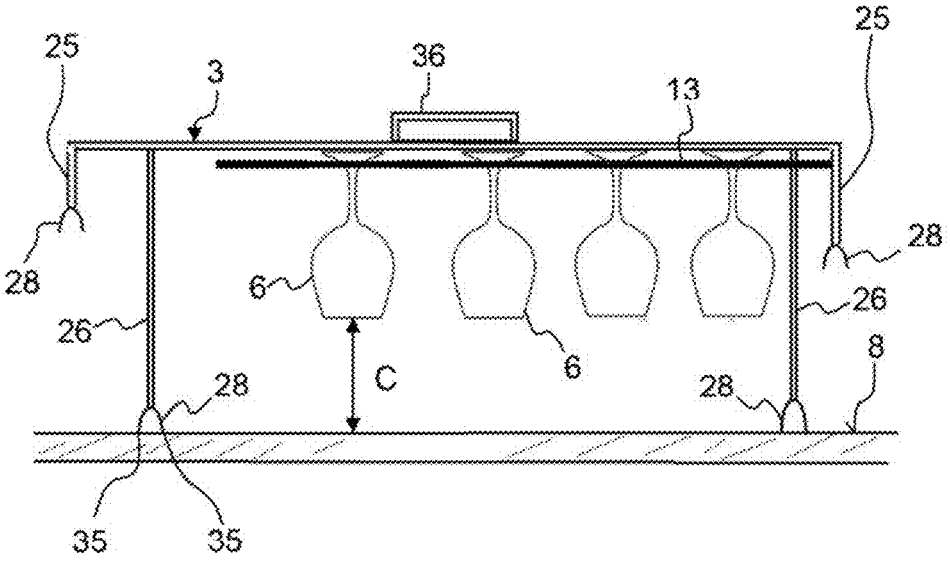
FIG. 6 shows a side view of FIG. 5.

It may also be seen in FIG. 4 is that the U-shape 28 has two free ends 35. The glass holder attachment 3 is positioned with the free ends 35 of its long feet 26 in FIG. 5 on the work surface 8. The work surface 8 is configured to be level. The feet 26 are dimensioned to be sufficiently long that the stemmed glasses 6 are at a distance C from the surface of the worktop 8. As a result, it is ensured that the glass holder attachment 3 is able to be loaded in a simple manner. The risk of damage to the stemmed glasses 6 is also reduced. Accordingly, the short feet 25 do not come into contact with the worktop 8. This may be identified clearly in FIG. 6 which shows a side view of FIG. 5.

Returning to FIG. 4 two handles 36 which are configured, for example, to be U-shaped are also shown therein. The handles 36 are fixedly attached to the lateral frame elements 10, 11. The glass holder attachment 3 may be handled in a simple manner by means of the handles in order to move the glass holder attachment from the lower basket 2 onto the worktop 8 and vice versa. The handles 36 are provided in each case oriented upwardly from the frame elements 10, 11 in order to be able to be gripped in a particularly simple manner. Relative to the width direction of the washing chamber 4 (see FIG. 1) this is also space-saving.

Finally, it may be provided that one or more of the feet 25, 26 are pivotably fastened to the frame 9. In the exemplary embodiment only the four long feet 26 are provided to be pivotable by means of pivot bearings 37—indicated by corresponding pivot axes. As a result, the long feet 26 may be folded back in parallel onto one respective frame element 10, 11 as illustrated in dashed lines for the foot 26'.

The above-described feet 25, 26 are all suitable for being set on the lower basket 2 and/or the corresponding wire elements 34 thereof, when the glass holder attachment 3 is set on the lower basket 2 (all denoted in the present case as "first" feet). Accordingly, only the long feet 26 are designed to be positioned on the level work surface 8, so that the glass holder attachment 3 is able to be set down on the work surface 8 (feet 26 also denoted as "second" feet). In other words, the feet 26 in the present case also have a dual function by serving both for setting the glass holder 3 on the lower basket 2 and also for setting down the glass holder 3 on the surface 8. The feet 26 form both first and second feet in the present sense. In this regard, however, other embodiments are conceivable. For example, the long feet 26 could exclusively serve for setting down on the worktop 8, whilst the setting on the lower basket 2 is carried out exclusively via the short feet 25. It might also be conceivable that exclusively the long feet 26, and no short feet 25, are provided.

Although the present invention has been described with reference to exemplary embodiments, it may be modified in many different ways.

All of the elements described above 2, 3, 10, 11, 12, 15, 16, 18, 25, 26, 27, 28, 29, 30, 31, 32, 33, 35, 36 and 37 may be produced from plastic and/or metal, in particular plastic-coated wire.

The invention claimed is:

1. A glass holder attachment for a dishwasher receptacle, said glass holder attachment comprising:

a holder configured to hold a plurality of stemmed glasses;

a plurality of first feet to enable the glass holder attachment to be set on an upper side edge of the dishwasher receptacle and washed together with the stemmed glasses in a dishwasher; and a plurality of second feet to enable the glass holder attachment to be set down on a level surface in such a manner that the stemmed glasses are arranged at a distance above the level surface.

2. The glass holder attachment of claim 1, wherein at least one member selected from the group consisting of the plurality of first feet and the plurality of second feet has a U-shape which is designed to encompass partially a wire element of the dishwasher receptacle when the glass holder attachment is set thereon and has free ends for positioning on the level surface when the glass holder attachment is set down thereon.

3. The glass holder attachment of claim 1, wherein at least one of the plurality of second feet is designed to be set on a base of the receptacle.

4. The glass holder attachment of claim 1, wherein at least one member selected from the group consisting of the plurality of first feet and the plurality of second feet is attached to the holder.

5. The glass holder attachment of claim 1, wherein at least one member selected from the group consisting of the plurality of first feet and the plurality of second feet is pivotably mounted to the holder.

6. The glass holder attachment of claim 1, further comprising a handle for setting the glass holder attachment onto the receptacle and for setting down the glass holder attachment on the level surface.

7. The glass holder attachment of claim 1, wherein the holder is designed to hold the stemmed glasses suspended in a row and/or in an inclined manner.

8. The glass holder attachment of claim 1, wherein the holder includes at least two parallel rods which are spaced apart from one another in order to receive stems of the stemmed glasses therebetween, at least one of the rods being designed to support stem-adjoining feet of the stemmed glasses upwardly.

9. The glass holder attachment of claim 8, wherein the rods are arranged at different heights.

10. The glass holder attachment of claim 1, further comprising a U-shaped frame including two lateral frame elements and a rear frame element arranged between the two lateral frame elements, wherein the holder is attached to the rear frame element, at least one member selected from the group consisting of the plurality of first feet and the plurality of second feet is attached to the two lateral frame elements, and/or handles are attached to the two lateral frame elements for setting the glass holder attachment onto the receptacle and for setting down the glass holder attachment on the surface.

11. A unit, comprising:

a dishwasher receptacle for items to be washed; and a glass holder attachment set onto the dishwasher receptacle and removable therefrom in order to set down the glass holder attachment on a level surface, said glass holder attachment comprising a holder configured to hold a plurality of stemmed glasses, a plurality of first feet to enable the glass holder attachment to be set on an upper side edge of the dishwasher receptacle and washed together with the stemmed glasses in a dishwasher, and a plurality of second feet to enable the glass holder attachment to be set down on the level surface in such a manner that the stemmed glasses are arranged at a distance above the level surface.

12. A dishwasher, comprising a unit which includes a dishwasher receptacle for items to be washed, and a glass holder attachment set onto the dishwasher receptacle and removable therefrom in order to set down the glass holder attachment on a level surface, said glass holder attachment comprising a holder configured to hold a plurality of stemmed glasses, a plurality of first feet to enable the glass holder attachment to be set on an upper side edge of the dishwasher receptacle and washed together with the stemmed glasses in the dishwasher, and a plurality of second feet to enable the glass holder attachment to be set down on the level surface in such a manner that the stemmed glasses are arranged at a distance above the level surface.

13. The glass holder attachment of claim 1, wherein at least one foot of the plurality of second feet is longer than at least one foot of the plurality of first feet.

14. The unit of claim 11, wherein at least one foot of the plurality of second feet is longer than at least one foot of the plurality of first feet.

15. The dishwasher of claim 12, wherein at least one foot of the plurality of second feet is longer than at least one foot of the plurality of first feet.

* * * * *